US006893018B2

(12) United States Patent
Inoue

(10) Patent No.: US 6,893,018 B2
(45) Date of Patent: May 17, 2005

(54) GAME MACHINE

(75) Inventor: Haruo Inoue, Tokyo (JP)

(73) Assignee: Dragon Co., Ltd., Tokyo (JP)

( * ) Notice: Subject to any disclaimer, the term of this patent is extended or adjusted under 35 U.S.C. 154(b) by 29 days.

(21) Appl. No.: 10/338,578

(22) Filed: Jan. 9, 2003

(65) Prior Publication Data

US 2004/0017041 A1 Jan. 29, 2004

(30) Foreign Application Priority Data

Jul. 24, 2002 (JP) ..... 2002-215562

(51) Int. Cl.[7] ..... A63B 71/00

(52) U.S. Cl. ..... 273/143 R; 273/138.1; 436/13; 436/16; 436/20

(58) Field of Search ..... 273/243 R, 138.1, 273/143 R; 463/13, 16, 20

(56) References Cited

U.S. PATENT DOCUMENTS 5,511,784 A * 4/1996 Furry et al. ..... 273/143 R
5,695,402 A * 12/1997 Stupak ..... 463/20
5,848,932 A * 12/1998 Adams ..... 463/20
6,024,642 A * 2/2000 Stupak ..... 463/20
6,033,307 A * 3/2000 Vancura ..... 463/20
6,059,289 A * 5/2000 Vancura ..... 273/143 R
6,159,095 A * 12/2000 Frohm et al. ..... 463/19
6,234,897 B1 * 5/2001 Frohm et al. ..... 463/20
6,336,863 B1 * 1/2002 Baerlocher et al. ..... 463/27
6,394,902 B1 * 5/2002 Glavich et al. ..... 463/20
6,398,218 B1 * 6/2002 Vancura ..... 273/138.1
6,533,273 B2 * 3/2003 Cole et al. ..... 273/138.1
6,554,704 B2 * 4/2003 Nicastro et al. ..... 463/20
6,612,574 B1 * 9/2003 Cole et al. ..... 273/138.1
6,612,575 B1 * 9/2003 Cole et al. ..... 273/138.1
6,620,045 B2 * 9/2003 Berman et al. ..... 463/25
6,632,140 B2 * 10/2003 Berman et al. ..... 463/18
6,634,945 B2 * 10/2003 Glavich et al. ..... 463/25
6,648,759 B2 * 11/2003 Vancura ..... 463/20
2002/0198038 A1 * 12/2002 Adams ..... 463/20
2003/0207710 A1 * 11/2003 Rodgers et al. ..... 463/20

FOREIGN PATENT DOCUMENTS

AU 725571 B * 10/2002

* cited by examiner

*Primary Examiner*—Mark S. Graham
*Assistant Examiner*—Dolores Collins
(74) *Attorney, Agent, or Firm*—Young & Thompson

(57) ABSTRACT

A game machine is provided with first, second and third reel rows, and each of the reel rows executes slot game independent from each other. The number of reel rows to be actuated is increased in proportion to the number of bet coins. When less than three coins are betted, a first privilege providing section is operated to judge whether the first winning is generated. The first and a second privilege providing sections are operated to judge whether the first winning and a second winning are generated when four coins are betted. Dividend coins are provided in the first winning and a free game in the second winning. A player may play slot game without betting a coin in the free game.

15 Claims, 19 Drawing Sheets

GAME MACHINE

BACKGROUND OF THE INVENTION

1. Field of the Invention

The present invention relates to a game machine that may execute plural games simultaneously.

2. Description Related to the Prior Art

As a game machine, a slot machine for example, the well-known types are a mechanical reel type that actually rotates plural reels with disposed symbols on their peripheries and a video type that simulatively displays rotations of the reels on CRT based on graphic data stored in ROM. In the slot machine, reels are rotated on operation of a start button or a start lever after a coin (including a medal and a token in this specification) is inserted. The win or the loss and the types of winning is determined according to the kind of symbol combination stopped on a winning line when each reel is stopped on operation of stop buttons provided for each of the reels or when each of the reels is stopped automatically and sequentially after a random time. If the winning is generated, dividend coins are dispensed in accordance with the type of winning. As to the types of winning, there are the winning achieved if one specific symbol is stopped on the winning line and the winning achieved if a symbol combination, "7"—"7"—"7" for example, is stopped on the winning line. The symbol combination of "7"—"7"—"7" provides a larger amount of dividend coins for the player.

In the mechanical reel type slot machine, fewer numbers and kinds of symbols may be disposed on a reel. Therefore, double reels having a transparent outer reel and an inner reel rotating inside of the outer reel are suggested. As to disposing symbols on both the outer reel and the inner reel, the numbers and the kinds of symbols to be disposed are increased, and that enables the increase in the numbers of the types of winning.

In addition, as to the slot machine of the mechanical reel type, there are plural reel units disposed in matrices form. For example, there are reel units in three rows and three arrays and the number of reel unit rows to be actuated multiplies in proportion to the number of bet. That is, the first reel row is actuated when one coin is betted, the first and the second reel rows are actuated when two coins are betted, and the first, second and third reel rows are actuated when three coins are betted. As the game is started, the reel units in the first reel row, the second reel row and the third reel row are rotated simultaneously, and then each reel row is stopped sequentially. The win or the loss is judged in each reel row, and each reel unit is controlled to stop based on the result. The dividend coins are dispensed in accordance with the odds corresponding to each of the reel rows. As such slot machine provides three chances to win, it stimulates the player's expectation to win.

However, in the slot machine having plural reel rows as described above, each reel row is judged whether the win or the loss, and the method of judging is the same as that of conventional slot machines having a single reel row. Hence such slot machine lacks a savor of the game because the contents of the game is the same as a conventional one, other than that the judging is executed three times in one game.

SUMMARY OF THE INVENTION

An object of the present invention is to provide a game machine that may provide various kinds of games.

Another object of the present invention is to provide a game machine that provides plural winnings with different privileges for a player.

In order to achieve the above-described objects and other objects, the game machine of the present invention includes plural game display devices for executing plural games independent from each other, a first privilege providing means, and a second privilege providing means. The first privilege providing means judges whether the first winning is completed in each game display device and provides the player with the first privilege if the first winning is completed. The second privilege providing means judges whether the second winning is completed in all of the game display devices, and provides the player with the second privilege, which is different from the first privilege, if the second winning is completed.

In a preferable embodiment of the present invention, the plural game display devices include plural reel rows, each of which has plural reel units set in a line, and the plural reel rows execute slot game independently from each other. The first privilege provides dividend coins and the second privilege a free game. Furthermore, if the second winning is completed, a determining game of condition of free game is automatically started for determining the number of times of the free game and the odds of the dividend coins. A first rotary disk and a second rotary disk are provided for executing the determining game of condition of free game. Plural numbers representing the number of the times of the free game are printed on the first rotary disk, and one of the number, pointed by a pointer when the first rotary disk is stopped, represents the number of the times of the free game. On the other hand, the odds of the dividend coins to be provided in the free game are printed on the second rotary disk, and the odds, pointed by a pointer when the second rotary disk is stopped, represents the odds of the dividend coins to be provided in the free game.

According to the present invention, the contents of the game is varied and that may enhance the savor of the game, since the second winning, whose privilege is different from that of the first winning, is provided in addition to the first winning for providing the first privilege. In the preferable embodiment of the present invention, the second privilege is a special game, and before providing the special game, a determining game of condition of the special game is automatically started. Accordingly, since the contents of the privileges in the special game are changed in accordance with the results of the determining game of condition of the special game, it adds much fun to the game.

BRIEF DISCRIPTION OF THE DRAWINGS

One with ordinary skill in the art would easily understand the above-described objects and advantages of the present invention when the following detailed description is read with reference to the drawings attached hereto.

PREFERRED EMBODIMENTS OF THE INVENTION

Figure 1:
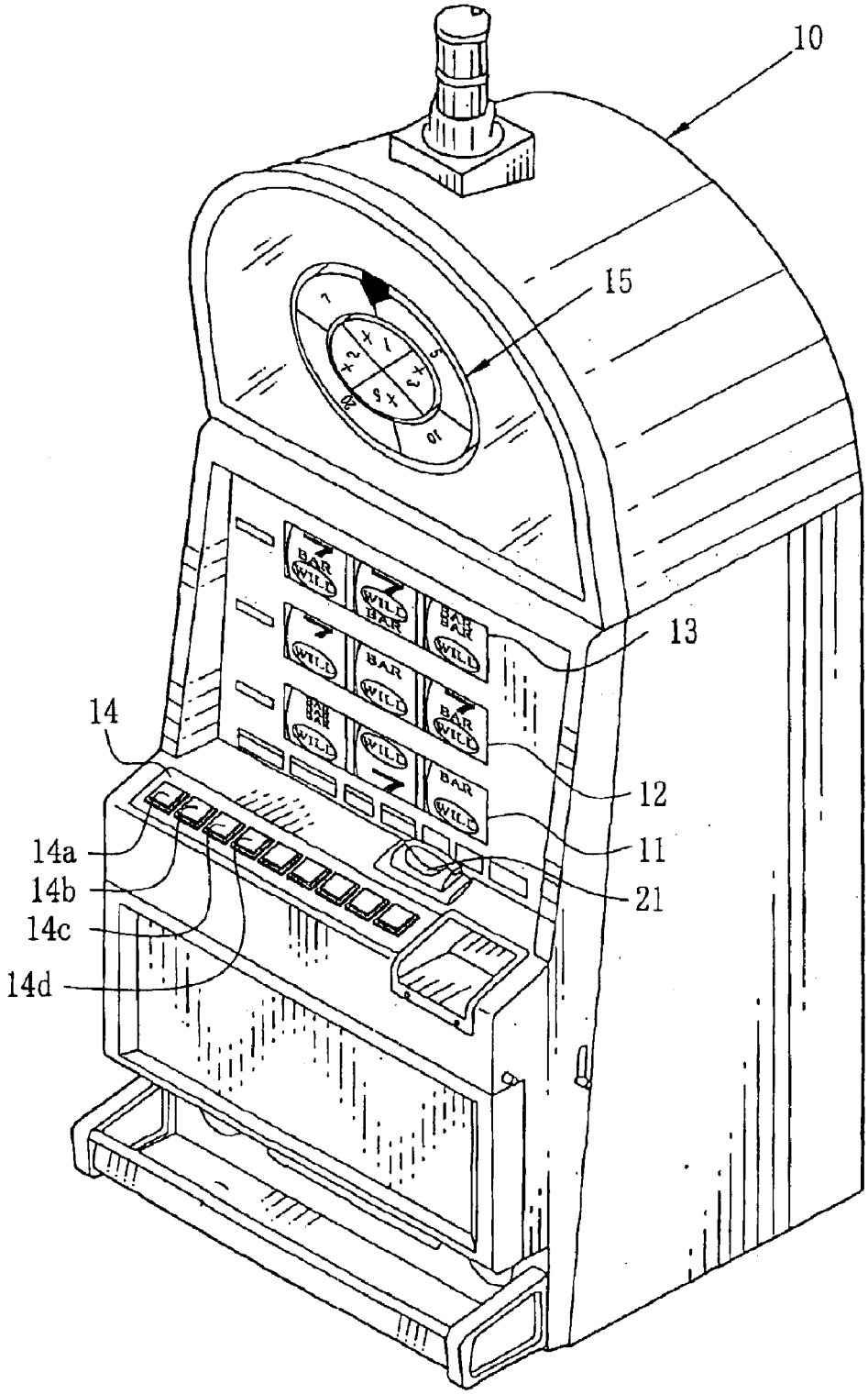
FIG. 1 is a perspective view of a slot machine of the present invention.

As shown in FIG. 1, first, second and third reel rows 11–13, an operation panel 14, a determining device for condition of free game 15, and a coin tray are provided at the front of a slot machine 10. Each of the first, second and third reel row composes each of game display devices for executing slot game.

Figure 2:
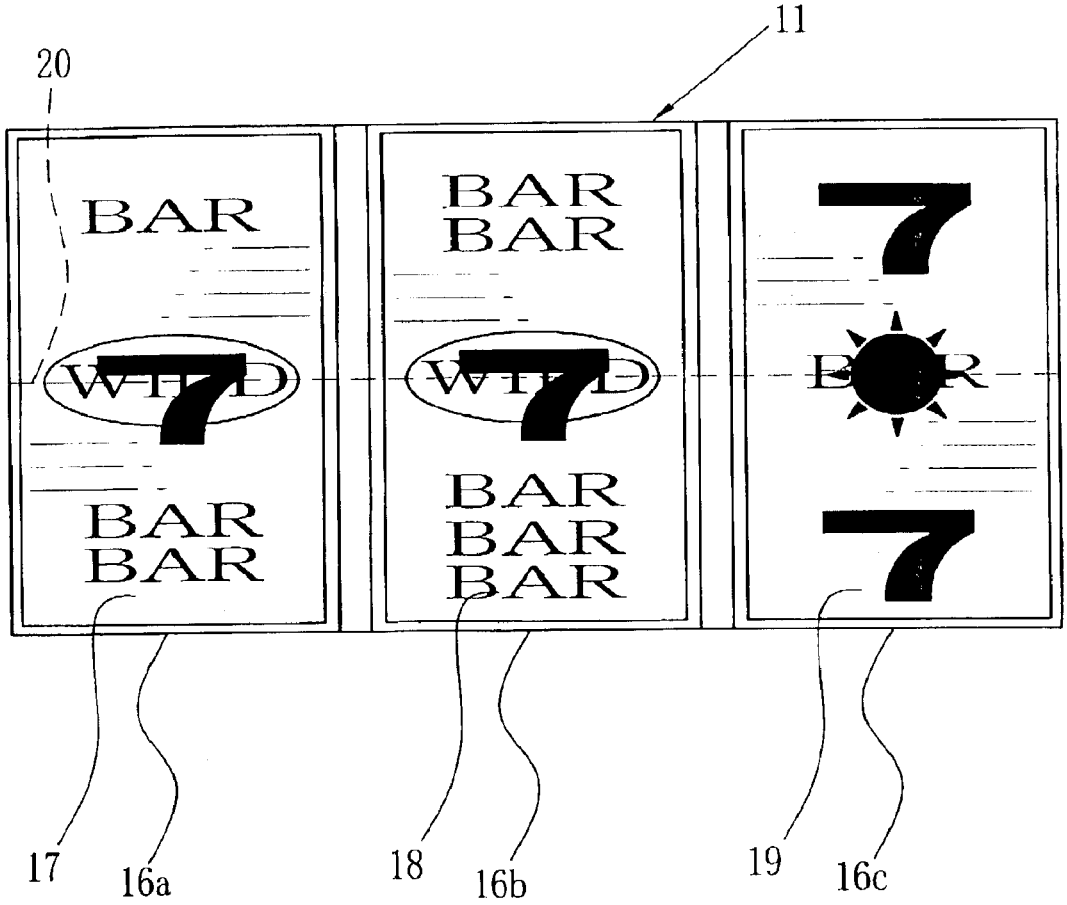
FIG. 2 is a front view of a reel row.

Since the first, second and third reel rows 11–13 have the same compositions as shown in FIG. 2, the compositions are described by using the composition of the first reel row 11 as an example. First, second and third reel units 17–19 are provided behind three symbol display windows 16*a*–16*c* in the first reel row 11. When the first, second and third reel units 17–19 stop rotating, three symbols on each reel unit, that is, nine symbols altogether may be observed through the symbol display windows 16*a*–16*c*.

A winning line 20, shown as a broken line in FIG. 2, is provided for determining a combination of the symbols when the first, second and third reel units 17–19 stop rotating. The winning line 20 is validated as a coin is inserted. Betting is executed by operation of one of 1 bet button 14*a*, 2 bets button 14*b* or 3 bets button 14*c* on the operation panel 14, after at least one coin is inserted into the coin slot 21. One coin is betted if the 1 bet button 14*a* is operated, and slot game is executed by the first reel row 11. On operation of the 2 bet button 14*b*, two coins are betted and slot game is executed twice with using the first and the second reel rows 11 and 12. Three coins are betted on operation of the 3 bet button 14*c* and slot game is executed three times with using the first, second and third reel rows 11–13. On operation of a 4 bet button 14*d*, slot game is executed three times by using the first, second and third reel rows 11–13 and a determining device of condition of free game 15.

Besides the 1–4 bet buttons 14*a*–14*d*, a game start button and a pay out button are provided on the operation panel 14. The first, second and third reel units 17–19 are rotated on operation of the game start button, and a player wins the first winning if a combination of winning symbols appears on the winning line 20.

Figure 3:
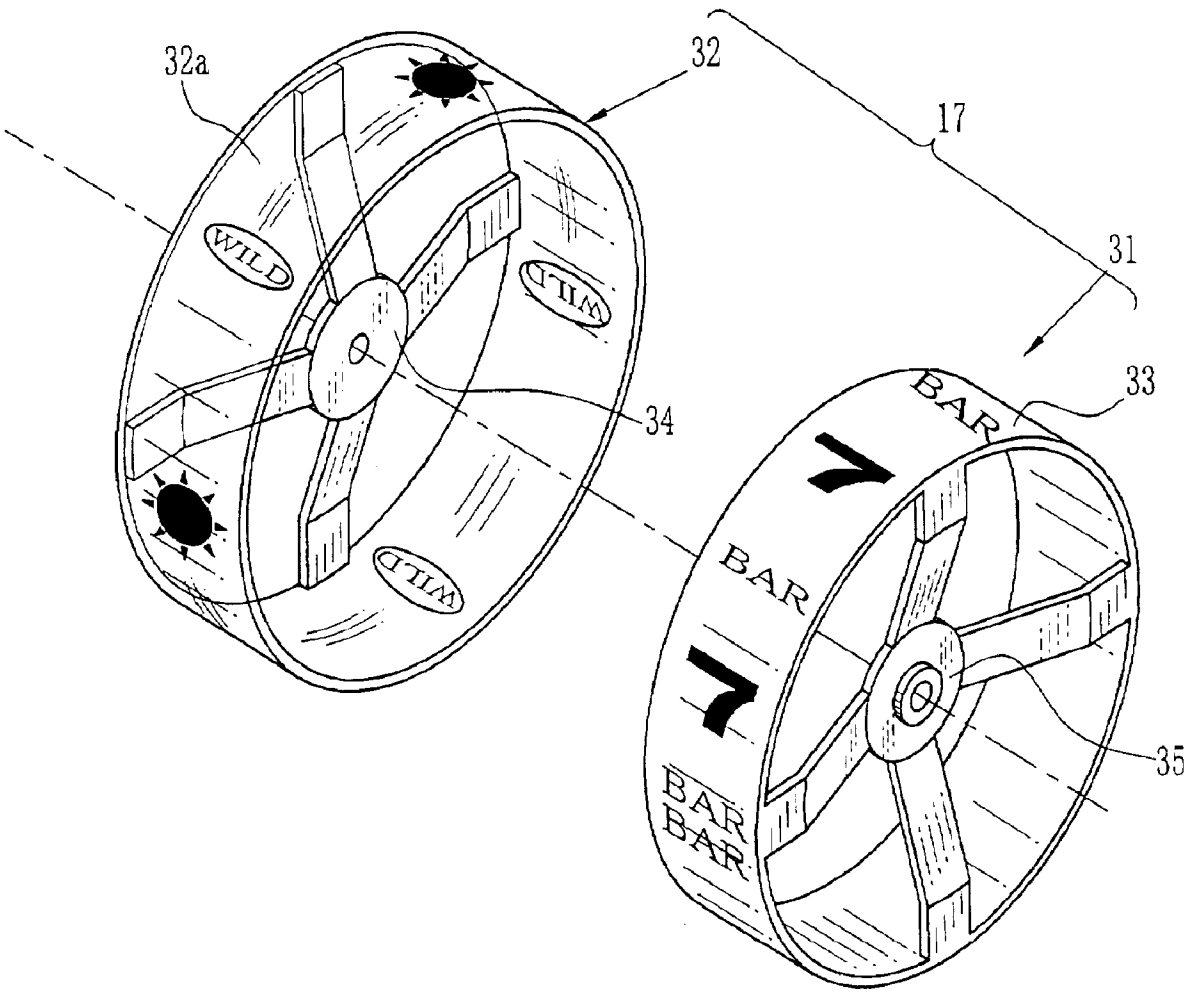
FIG. 3 is a perspective view of a composition of a reel unit.
Figure 4:
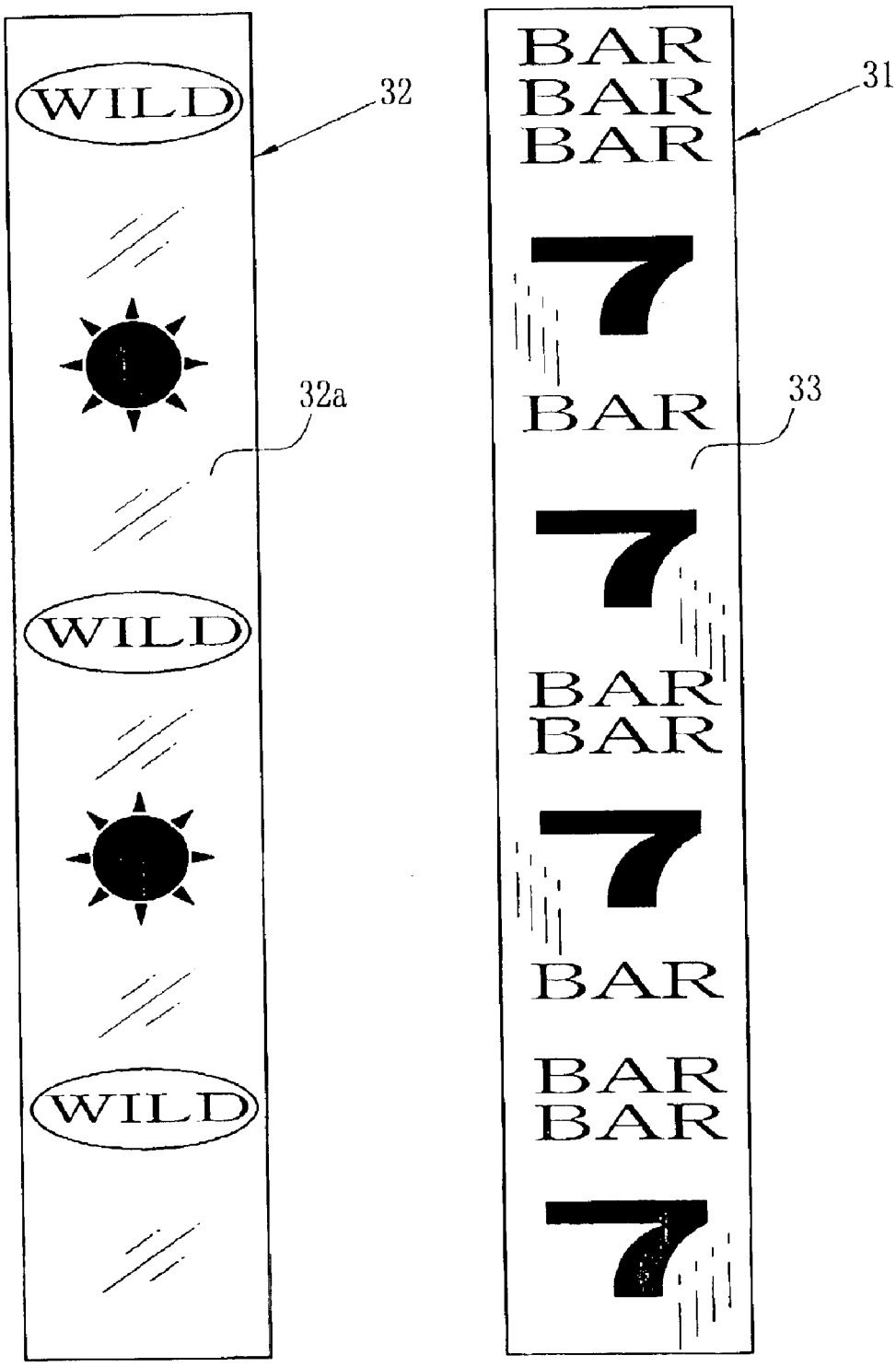
FIG. 4 is an explanation drawing of a composition of symbols disposed on an inner reel and an outer reel.

As shown in FIG. 3 and FIG. 4, each of the first, second and third reel units 17–19 is composed of double reels of an inner reel 31 and an outer reel 32. Since the first, second and third reel units 17–19 have the same compositions, their compositions are described by using the composition of the first reel unit 17 as an example. The inner reel 31 is made of an opaque resin having endurance, and its periphery is wrapped with a white symbol sheet 33, on which 5 kinds of symbols are printed. Those symbols are "7", "Bar", "2× Bar", and "3× Bar", and they are hit symbols. Since the outer reel 32 is made of a transparent resin, the symbols on the inner reel 31 may be observed through the outer reel 32. Two kinds of symbols "WILD"s and trigger symbols are printed on a periphery 32*a* of the outer reel 32. There are blank spaces between the symbols. Note that the "WILD" is a hit symbol and substitutes for any other symbols. A winning combination is completed by the combination of the winning symbols on the inner reel 31 or by the combination of the winning symbol on the inner reel 31 and the "WILD" on the outer reel 32.

Attaching plates 34 and 35 are integrally formed in the inner reel 31 and the outer reel 32 respectively, and the inner reel 31 and the outer reel 32 are fixed to stepping motors through the attaching plates 34 and 35. Thereby, the inner reel 31 and the outer reel 32 are respectively rotated by each of the stepping motors. The first, second and third reel rows 11–13 execute a slot game when 4 coins are betted, and if at least one trigger symbol appears on each reel row 11–13 as the game ends, it means that the player wins a free game (winning of gaining a free game) and the determining game of condition of the free game is executed as the privilege for the player.

In the determining game of condition of free game, the number of times of free games (free slot games) to be executed is determined as well as the odds of dividend coins to provide if the player wins the first winning while playing the free game. In the free game, the player may play slot game without betting a coin. Note that the winning of gaining a free game is the second winning.

Figure 5:
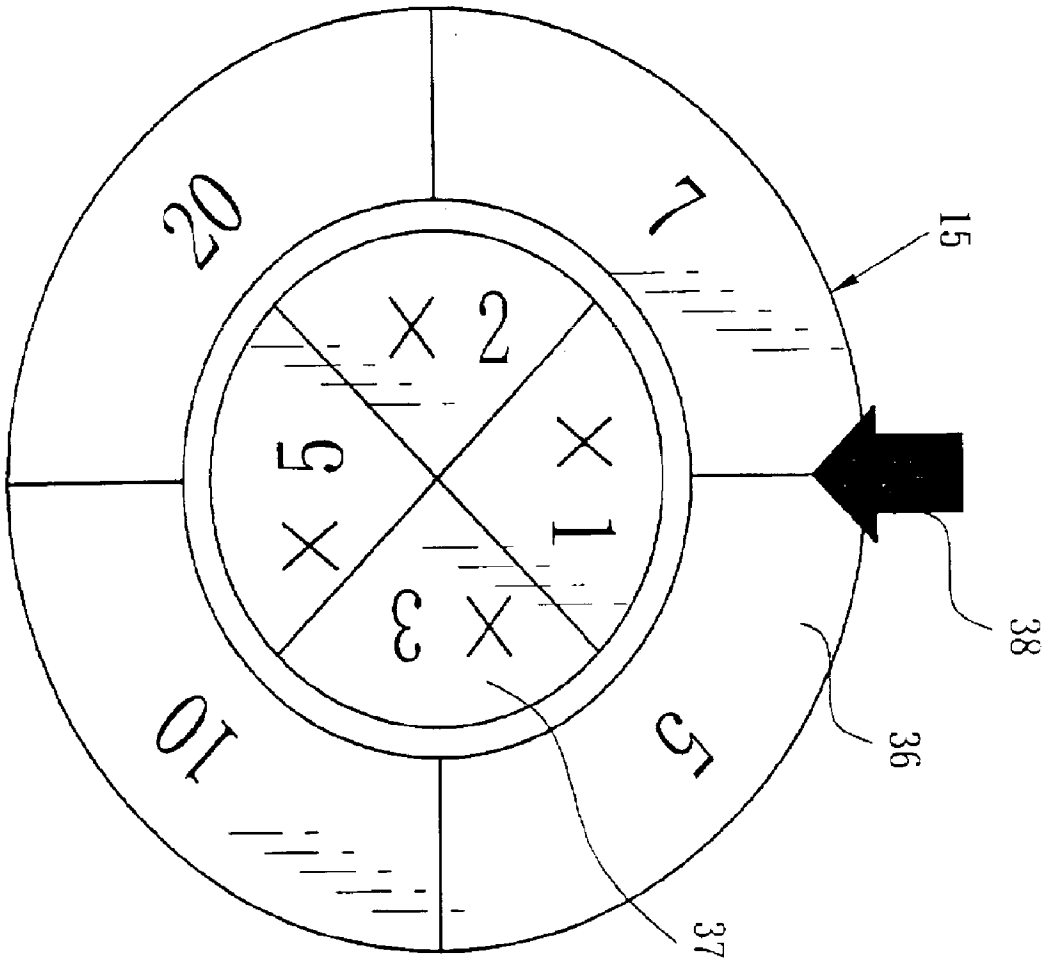
FIG. 5 is an explanation drawing of a composition of a determining device of condition of free game.

As shown in FIG. 5, a determining device of condition of free game 15 is composed of a first rotary disk 36, a second rotary disk 37, and an indicator 38. As the determining game of condition of free game starts, the first rotary disk 36 starts rotating.

The first rotary disk 36 is divided into 4 parts, and in each of them a symbol representing the number of times of free game is printed. The symbols on the first rotary disk 36 are "5", "7", "10", and "20", and the "5" represents that the player may have 5 times of free games. Similarly, the "7", the "10", and the "20" respectively represents that the player may have 7 times, 10 times and 20 times of free games.

The second rotary disk 37 is also divided into 4 parts, and in each of them a symbol representing the odds of the dividend coins is provided. The symbols on the second rotary disk 37 are "×1", "×2", "×3", and "×5", and the "×1" represents that the player may gain as many dividend coins as that gained in a regular slot game if the player wins in the free game. The "×2", "×3", and "×5" respectively represents that, if the player wins in the free game, the player may gain 2 times, 3 times and 5 times as many dividend coins as that gained in a regular slot game.

Figure 6:
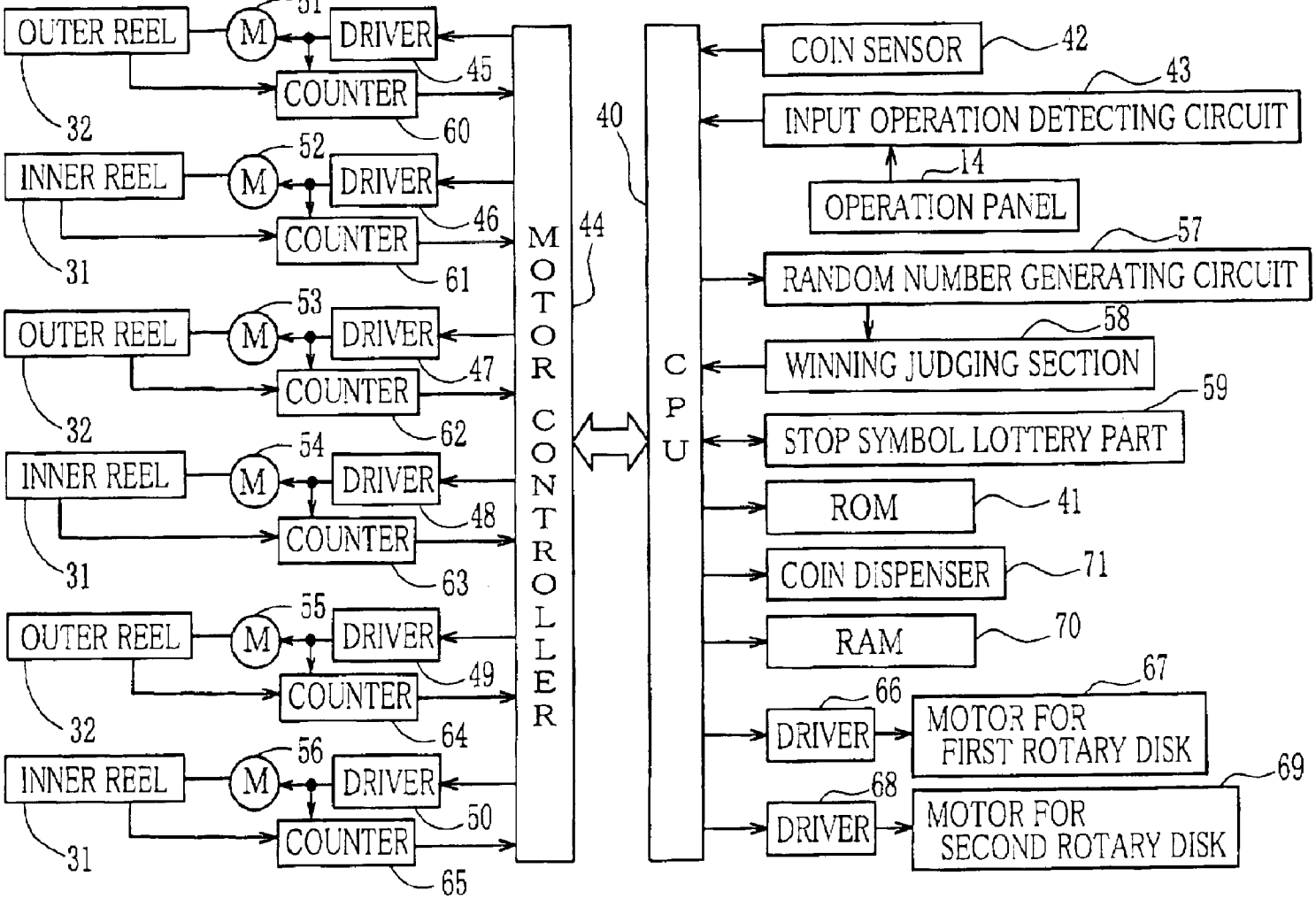
FIG. 6 is a block diagram of an electrical composition of the slot machine.

As shown in FIG. 6, the slot machine 10 is operated by a CPU 40 reading out exerciser for slot game from a ROM 41. A coin sensor 42 is provided behind the coin slot 21, and inputs coin detecting signals to the CPU 40 every time upon detecting insertion of proper coins.

On operation of the 1–4 bet buttons 14*a*–14*c* on the operation panel 14, an operation signal is inputted from an operation input detecting circuit 43 to the CPU 40. When the game start button is operated, a start signal is inputted in the CPU 40, which operates a motor control part 44 in response to the start signal. The CPU 40 actuates the first, second and third reel rows 11–13 in accordance with the number of bet coins, and has the motor control part 44 control to stop the first, second and third reel units 17–19. The motor control part 44 supplies driving pulses to stepping motors 51–56 through drivers 45–50 in order to rotate the inner reel 31 and the outer reel 32.

Simultaneously with that the start signal is inputted to the CPU 40, a random number generating circuit 57 samples a random number, and the sampled random number is inputted in a winning judging section 58. Upon the input of the random number, the winning judging section 58 determines whether the win or the loss, or the type of winning in the game being played at the moment. If the winning judging section 58 determines to generate the win, it inputs a winning determining signal to the CPU 40 in accordance with the type of the winning. In response to the winning determining signal, the CPU 40 operates a stop symbol lottery part 59.

Figure 7:
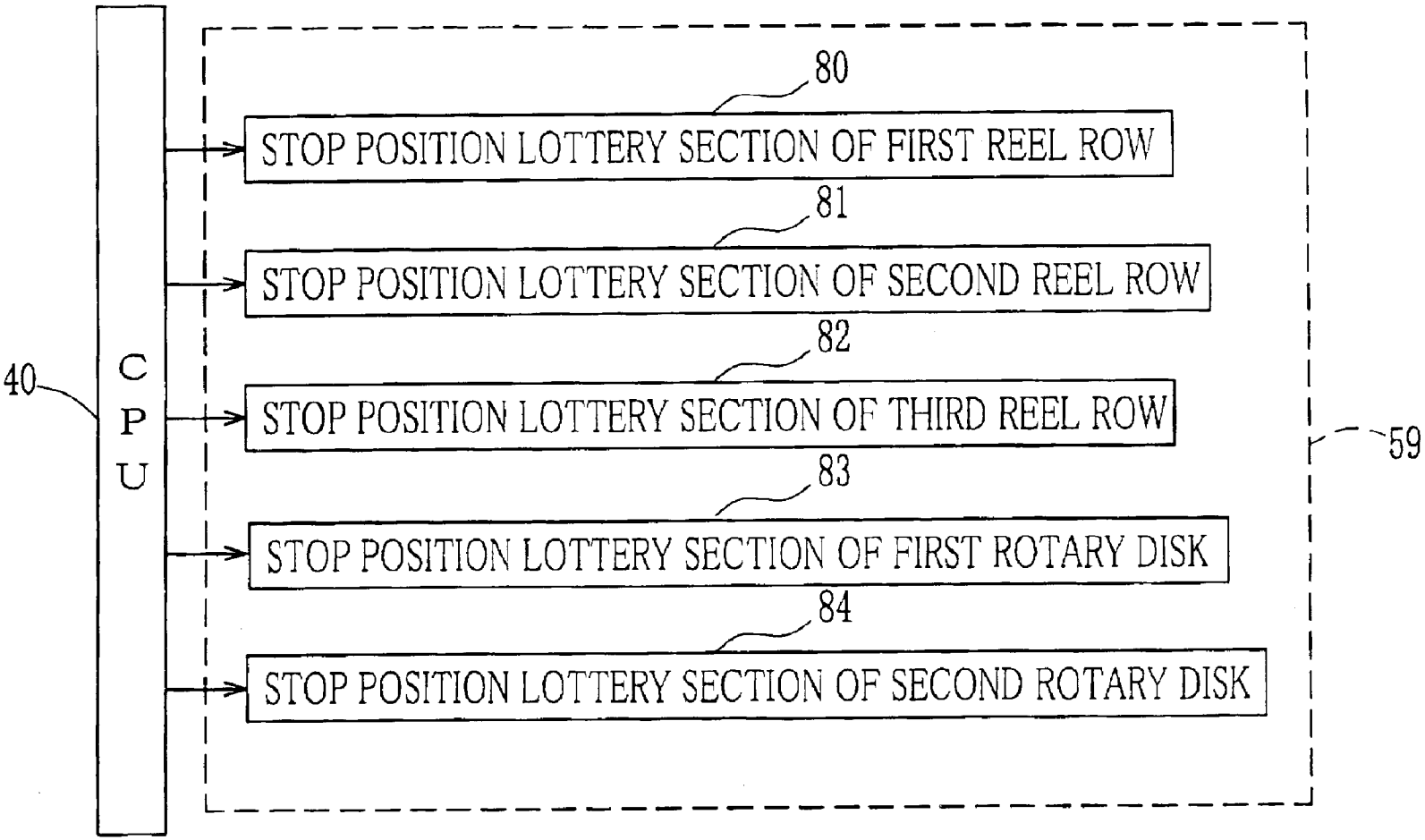
FIG. 7 is an explanation drawing of a composition of a stop symbol lottery part.

As shown in FIG. 7, the stop symbol lottery part 59 is composed of a stop position lottery section of first reel row 80, a stop position lottery section of second reel row 81, a stop position lottery section of third reel row 82, a stop position lottery section of first rotary disk 83, and a stop position lottery section of second rotary disk 84. The stop position lottery section of first reel row 80, the stop position lottery section of second reel row 81 and the stop position lottery section of third reel row 82 are respectively operated when the first reel row 11, the second reel row 12 and the third reel row 13 are operated.

Each of the stop position lottery section of first, second and third reel rows 80–82 is provided with random number generating circuits and reel stop position determining tables. In the reel stop position determining tables, all of the random numbers generated in the random number generating circuits of each drawing part are grouped and, to the grouped random numbers, the stop positions for the inner reel 31 and the outer reel 32 in the first, second and third reel units 17–19 are allocated. Therefore, when the stop position lottery section of first, second and third reel rows 80–82 are operated and the random numbers generated in the random number generating circuits are checked with the reel stop position determining tables, the stop positions for the inner reel 31 and the outer reel 32 are determined Each of the stop position lottery section of first rotary disk 83 and the stop position lottery section of second rotary disk 84 are operated in the determining game of condition of the free game. The stop position for the first rotary disk 36 is determined by lottery in the stop position lottery section of first rotary disk 83, and the stop position for the second rotary disk 37 is determined by lottery in the stop position lottery section of second rotary disk 84.

Signal fragments are provided at the inner reel 31 and the outer reel 32 for indicating their reference positions, and the rotations of the signal fragments are observed by photo interrupters. The photo interrupter outputs reset signals on every rotation of the inner reel 31 and the outer reel 32 and, by the reset signals, discrete values of counters 60–65 for counting the number of the driving pulses are reset to "0". Accordingly, the discrete values of the counter 60–65 represent positions of the reels in one rotation. Since rotational positions of the inner reel 31 and the outer reel 32 are predetermined as well as the kinds and the arrangement of the symbols disposed on the inner reel 31 and the outer reel 32, the kinds of the symbols stopped on the winning line 20 may be figured out by observing the number of the driving pulses supplied to the stepping motors 51–56.

In the determining game of condition of free game, the CPU 40 drives a motor for first rotary disk 67 through a driver 66 for a predetermined time and then drives a motor for second rotary disk 69 through a driver 68 for the predetermined time.

If the winning is generated, the CPU 40 stores dividend coins in a RAM 70 in accordance with the generated winning type, by referring to data of the amount of the dividend coins stored in the ROM 41. On operation of the payout button on the operation panel 14, a coin dispenser 71 is driven and payouts as many dividend coins as the amount stored in the RAM 70. Note that other than an area for remembering the amount of dividend coins, the RAM 70 is provided with areas for remembering the amount of bet coins betted and for remembering the amount of inserted coins. The RAM 70 is used as a memory to temporarily store various data in the game processing.

Figure 8:
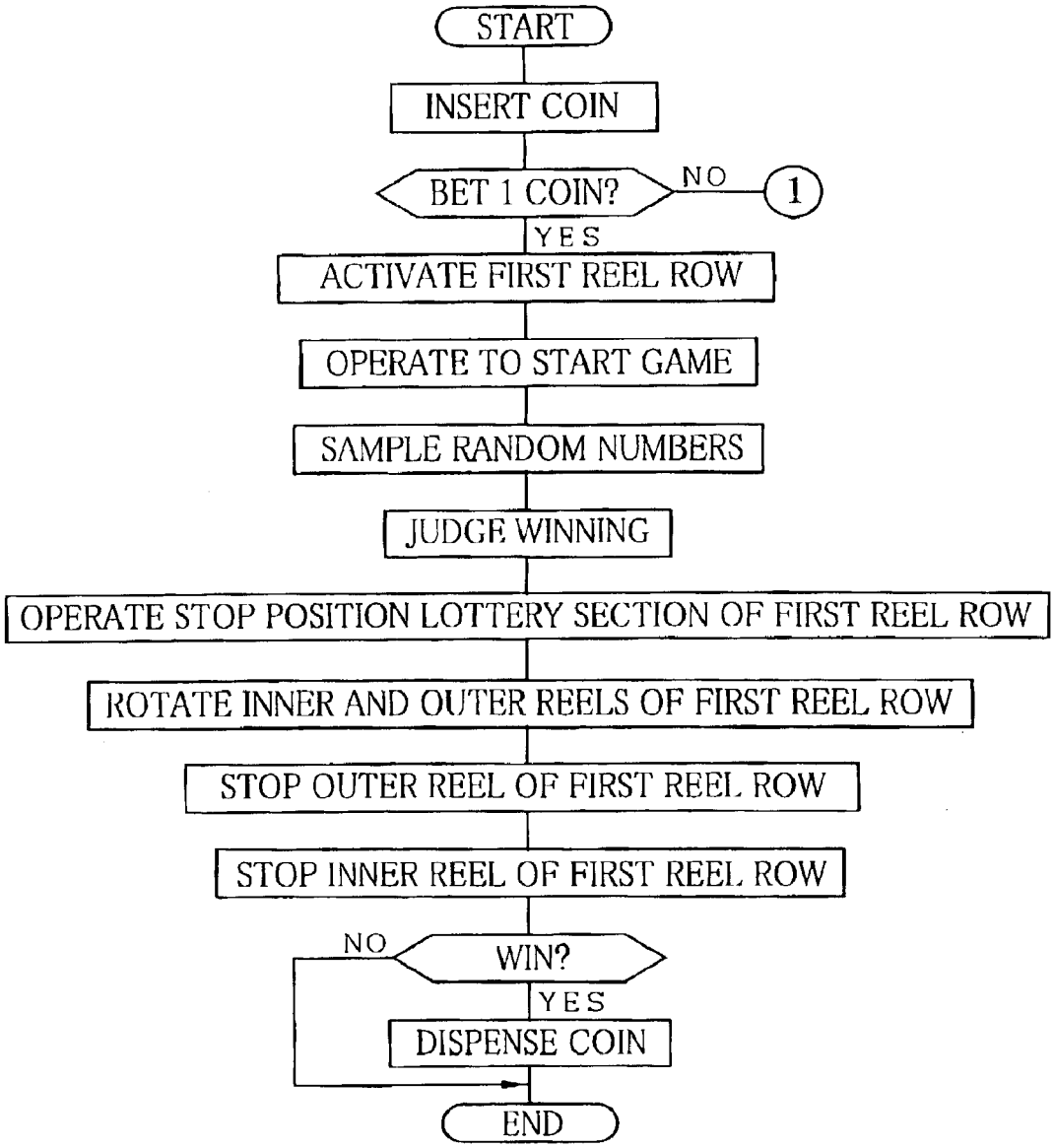
FIG. 8 is a flow chart of process of the game executed if one coin is betted.

Next, functions of the slot machine 10 are explained. As shown in FIG. 8, when the player inserts a coin into the coin slot 21, a coin detecting signal is inputted from the coin sensor 42 to the CPU 40. On operation of one of the 1–4 bet buttons 14*a*–14*d* on the operation panel 14 by the player after inserting appropriate amount of coins, an operation signal is inputted from the operation input detecting circuit 43 to the CPU 40, and the first, second and third reel rows 11–13 are actuated in accordance with the amount of the bet coins.

One coin is betted as the 1 bet button 14*a* is operated, and the first reel row 11 is validated. As the player operates the game start button to start the slot game, a start signal is inputted in the CPU 40, which operates the random number generating circuit 57 in response to the start signal. Random numbers are sampled in the random number generating circuit 57, and the sampled random numbers are inputted in a winning determining part 58. The winning determining part 58 determines whether to generate the winning or not and a type of winning by lottery.

Then, the CPU 40 operates the stop position lottery section of first reel row 80. The stop positions for the inner reel 31 and the outer reel 32 are determined in the stop position lottery section of first reel row 80 by lottery.

After that, the CPU 40 actuates the motor controlling part 44 to start rotations of the inner reels 31 and the outer reels 32 in the first reel row 11. After a predetermined time since the inner reels 31 and the outer reels 32 have started rotating, the CPU 40 has the motor controlling part 44 control to stop the outer reel 32 in accordance with the result determined in the stop position lottery section of first reel row 80, and then to stop the inner reel 31.

The player wins the slot game if the combination of winning symbols of the inner reel 31 is completed on the winning line 20, or if a predetermined combination of the symbol on the inner reel 31 and the "WILD" on the outer reel 32 appears on the winning line 20. If those winning are generated, the CPU 40 stores dividend coins in accordance with the type of the winning generated in the RAM 70, with reference to the data of the amount of dividend coins stored in the ROM 41. On operation of the payout button on the operation panel 14, the coin dispenser 71 is driven and the coins stored in the RAM 70 are dispensed to the coin tray. Accordingly, the CPU 40 has functions to provide the player with the coins as well.

Figure 9:
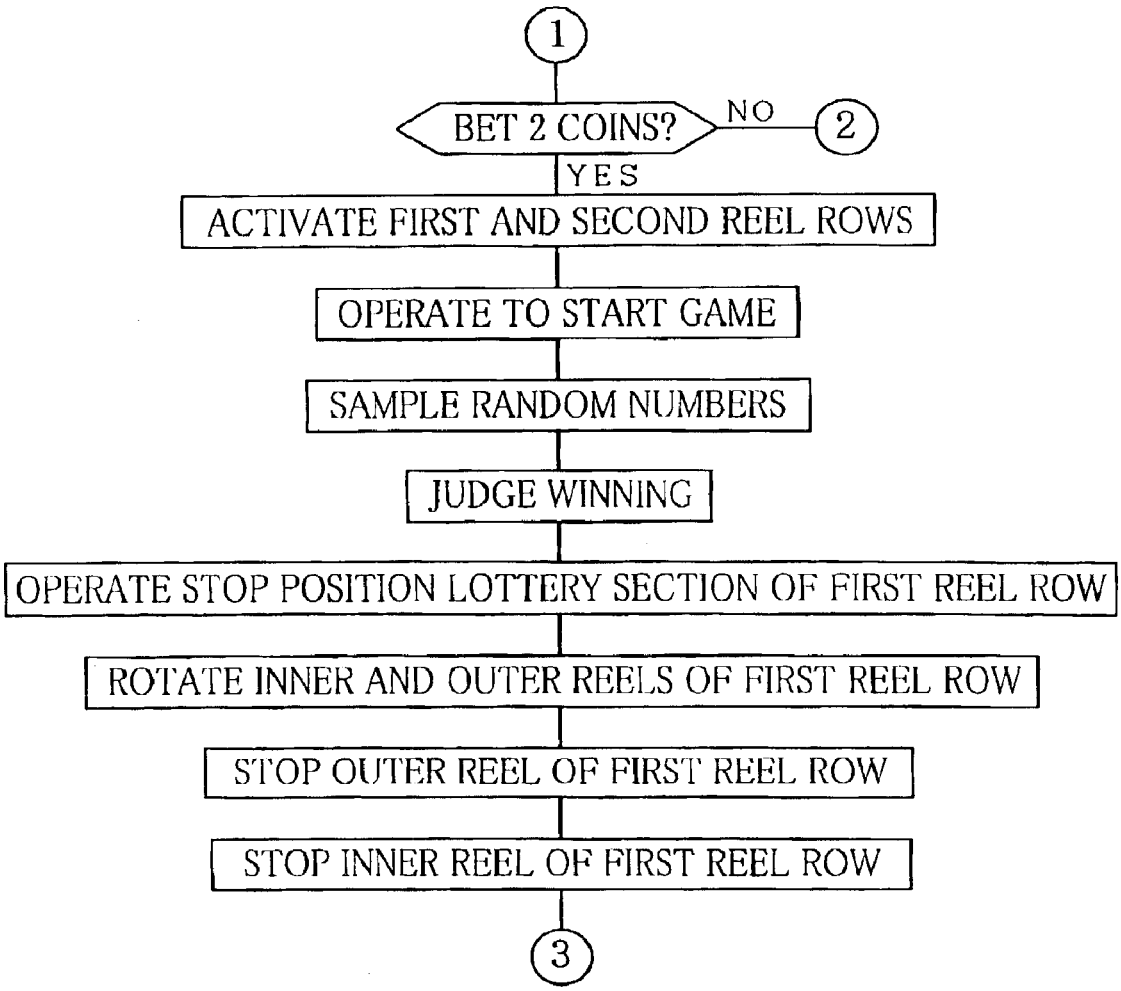
FIG. 9 is a flow chart of first half of process of the game executed if two coins are betted.
Figure 10:
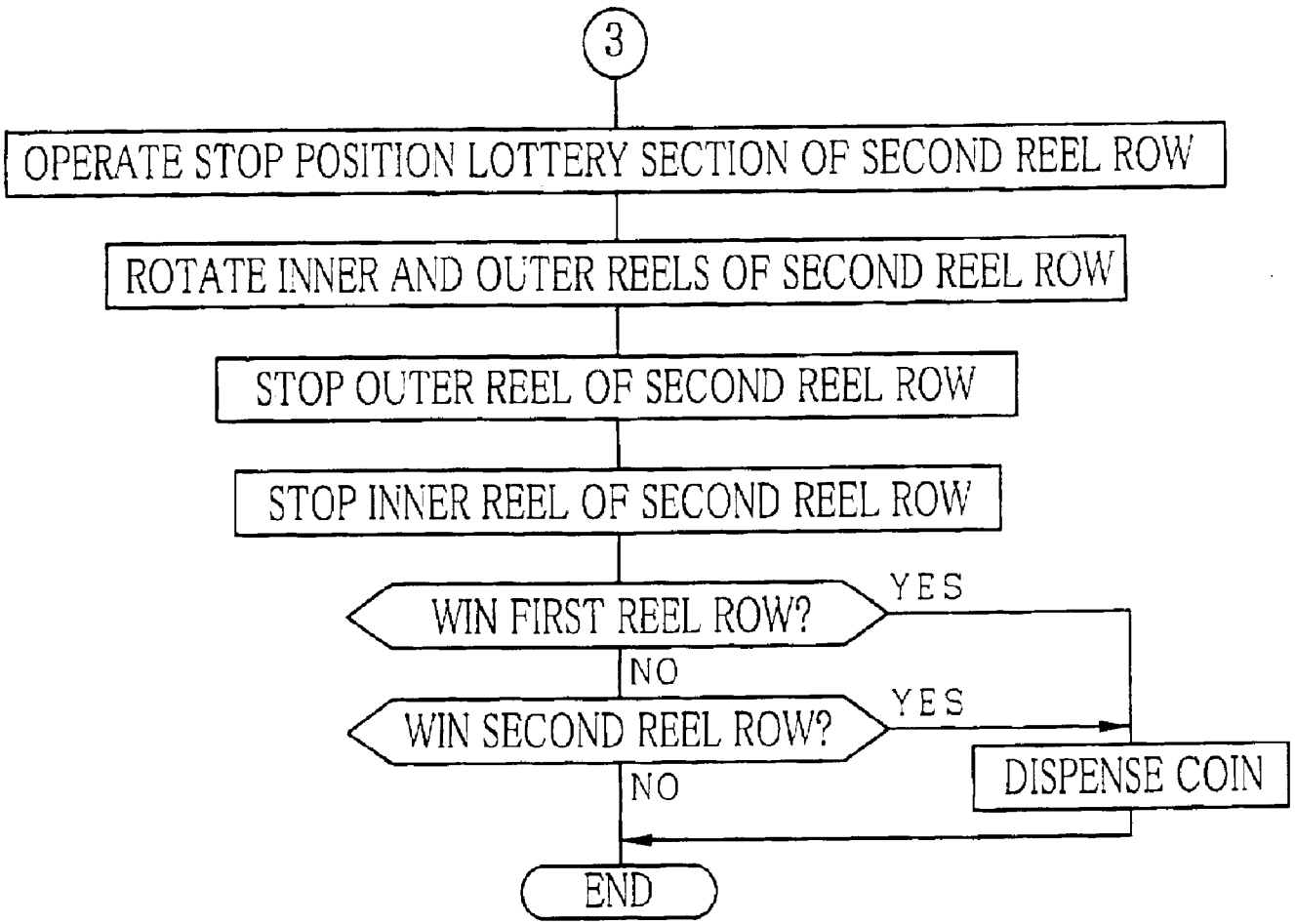
FIG. 10 is a flow chart of second half of the game shown in FIG. 9.

As shown in FIG. 9 and FIG. 10, the first and the second reel rows 11 and 12 are actuated as the 2 bet button 14*b* is operated and 2 coins are betted. On operation to start the game, the random numbers are sampled and the winning judgment is executed. Also, the stop positions for the inner reels 31 and the outer reels 32 of the first reel row 11 are determined by the stop position lottery section of first reel row 80. Then, the CPU 40 actuates the motor controlling part 44 to start rotations of the inner reels 31 and the outer reels 32 of the first reel row 11. After a predetermined time since the reels have started rotating, each reel unit of the inner reels 31 and the outer reels 32 is controlled to stop the outer reels 32 first and then the inner reels 31.

When the inner reel 31 and the outer reel 32 of the first reel row 11 are stopped, the stop position lottery section of second reel row 81 is operated to determine the stop positions for the inner reel 31 and the outer reel 32 of the second reel row 12. After a predetermined time since the reels have started rotating, first the outer reel 32 and then the inner reel 31 of the second reel row 12 are controlled to stop. If the winning is generated in at least one of the first reel row 11 or the second reel row 12, the coins are dispensed.

Figure 11:
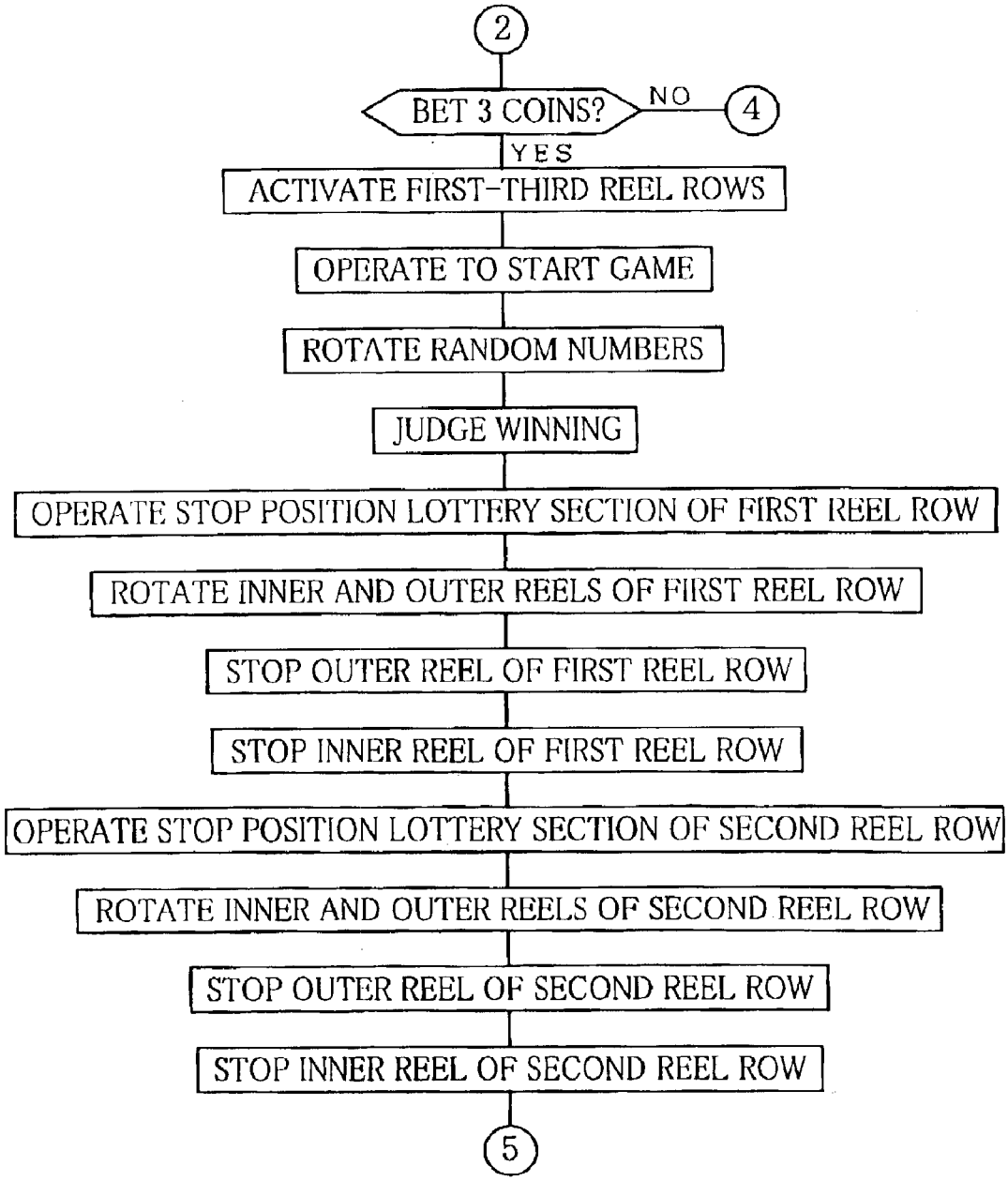
FIG. 11 is a flow chart of first half of process of the game executed if three coins are betted.
Figure 12:
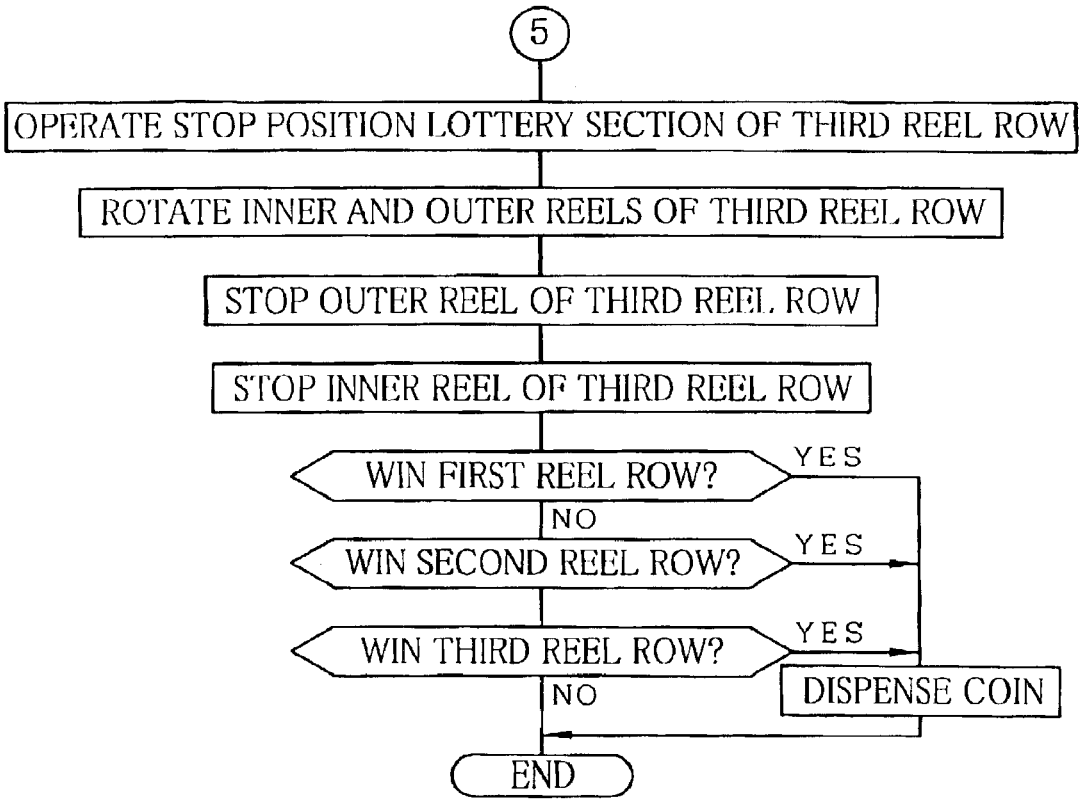
FIG. 12 is a flow chart of second half of the game shown in FIG. 11.

As shown in FIG. 11 and FIG. 12, the first, second and third reel rows 11–13 are actuated as the 3 bet button 14*c* is operated and 3 coins are betted. On operation to start the game, random numbers are sampled and the winning judgment is executed. In addition, similarly with the case of betting 2 coins, the inner reels 31 and the outer reels 32 of the first reel row 11 and the second reel row 12 are controlled to rotate and to stop. After the inner reels 31 and the outer reels 32 of the second reel row 12 stop rotating, the stop position lottery section of third reel row 82 is operated to control to rotate and to stop the inner reel 31 and the outer reel 32 in the third reel row 13. Coins are dispensed if the winning is generated in any of the first, second and third reel rows 11–13.

Figure 13:
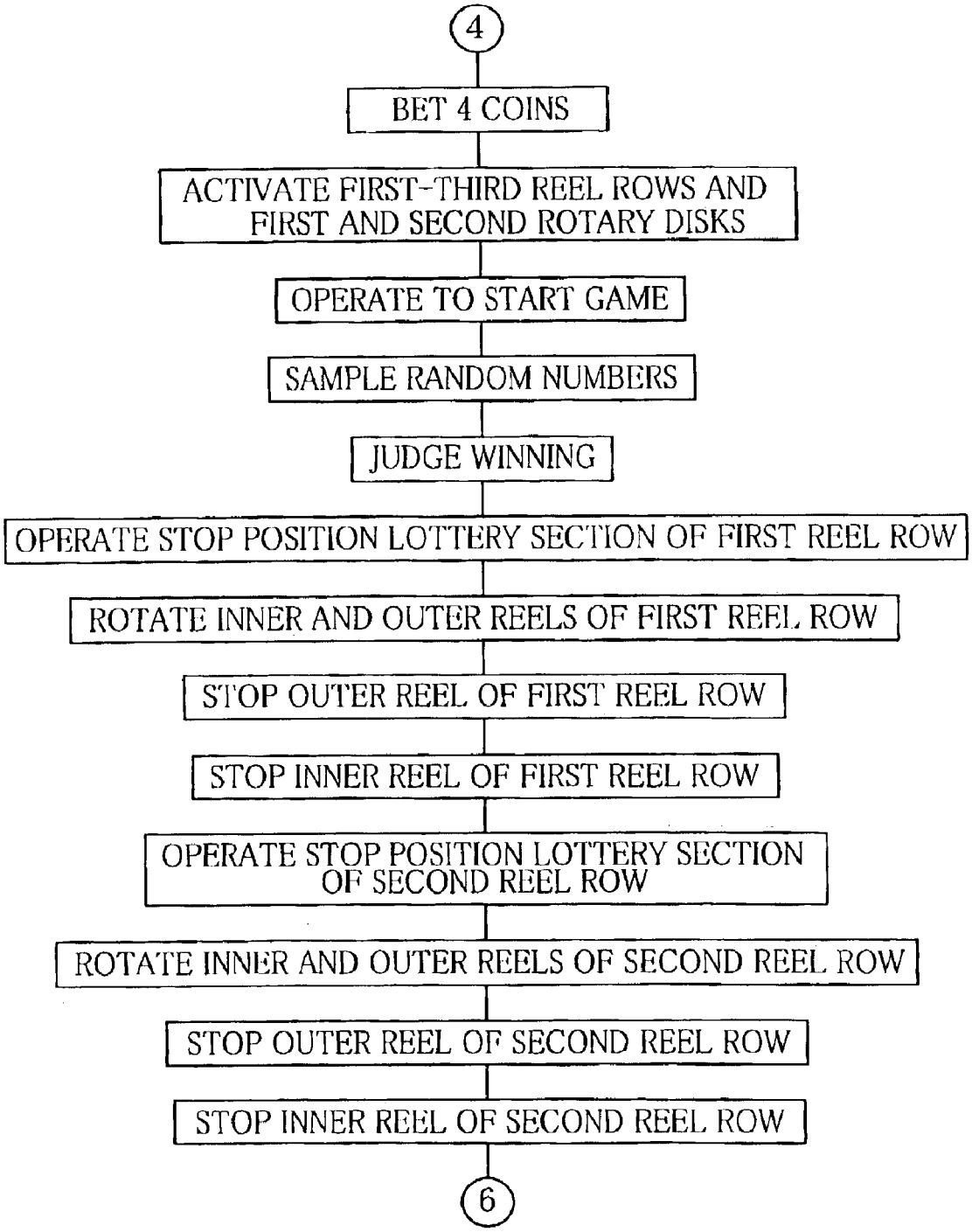
FIG. 13 is a flow chart of first half of process of the game executed if four coins are betted.
Figure 14:
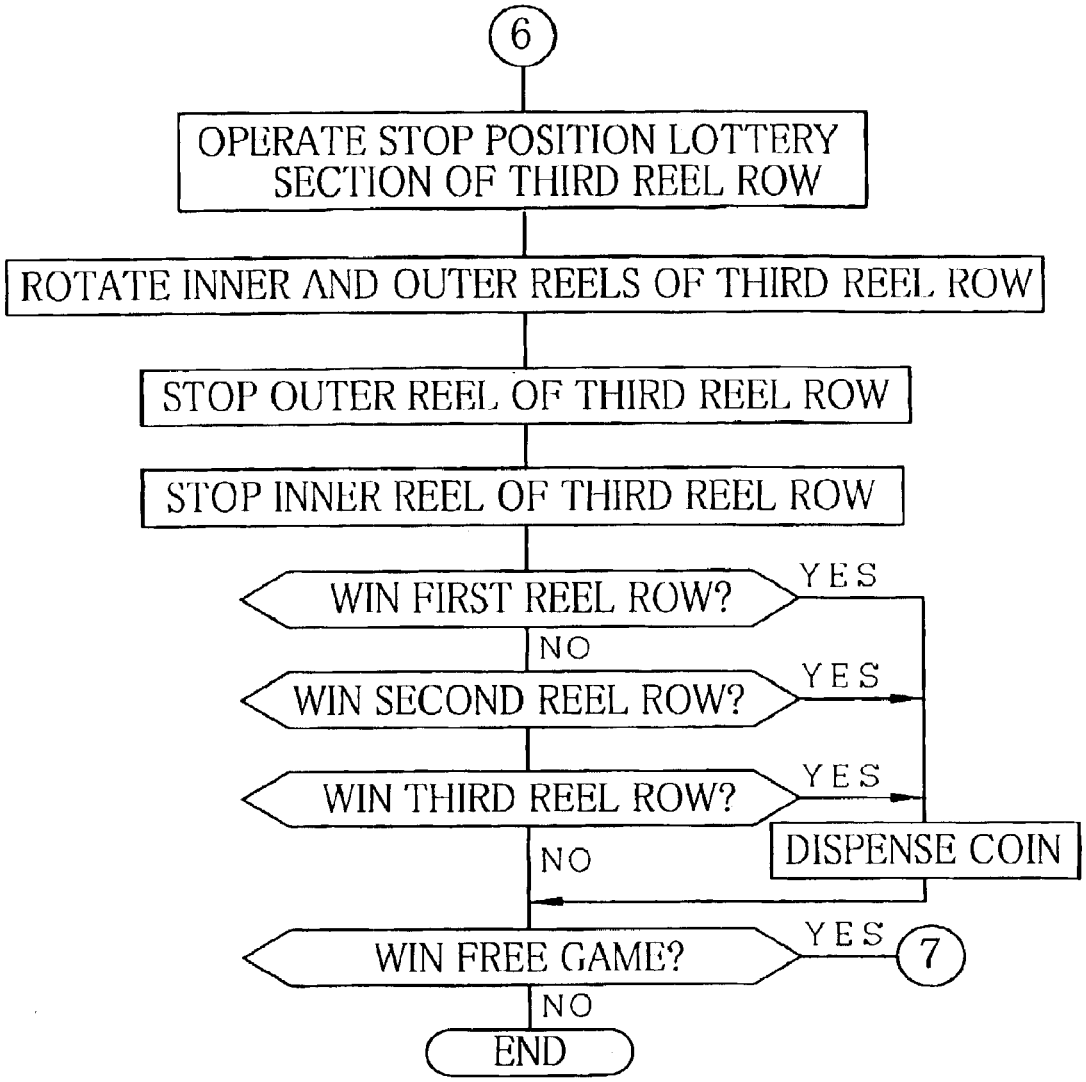
FIG. 14 is a flow chart of second half of the game shown in FIG. 13.

As shown in FIG. 13 and FIG. 14, as the 4 bet button 14*d* is operated and 4 coins are betted, the first, second and third reel rows 11–13 and the first and second rotary disks 36 and 37 are actuated. On operation to start the game, random numbers are sampled and the winning judgment on the random numbers is executed. In addition, similarly with the case of betting 3 coins, the inner reels 31 and the outer reels 32 of the first, second and third reel rows 11–13 are controlled to rotate and to stop. Coins are dispensed if the winning is generated in any of the first, second and third reel rows 11–13.

Figure 15:
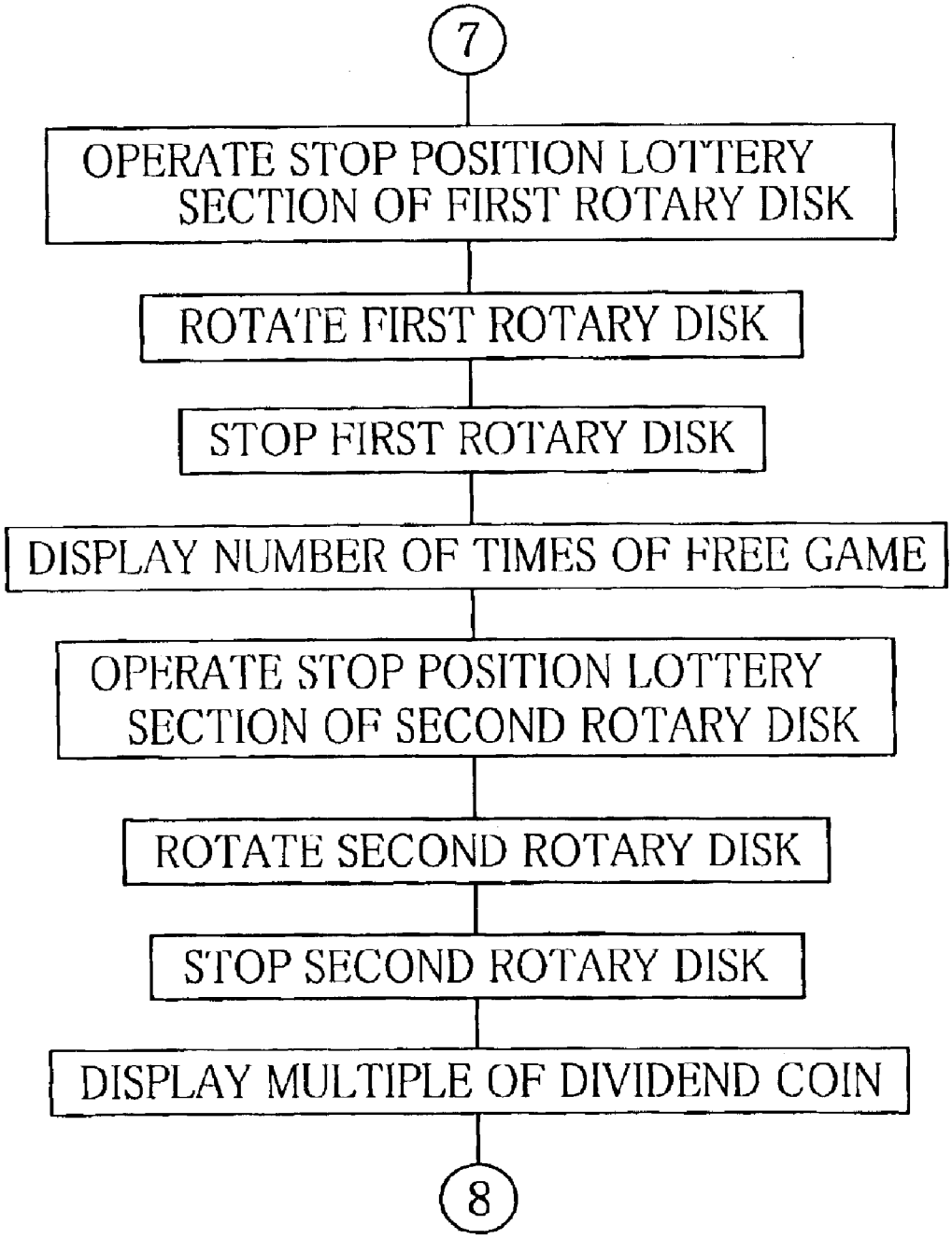
FIG. 15 is a flow chart of determining game of condition of free game.

As shown in FIG. 15, if at least one "trigger symbol" appears in each reel row when the first, second and third reel rows 11–13 end the game, it means that the player wins a free game, and the determining game of condition of the free game is executed. As the determining game of condition of the free game starts, the CPU 40 actuates the stop position lottery section of first rotary disk 83, where the stop position for the first rotary disk 36 is determined by lottery. Then, the CPU 40 drives the motor for first rotary disk 67 through the driver 66 to rotate the first rotary disk 36. After a predetermined time since the first display 36 has started rotating, the first rotary disk 36 is stopped at the position determined by the stop position lottery section of first rotary disk 83. The number, indicated by the indicator 38 when the first rotary disk 36 stops rotating, is the number of times to execute the free game.

After the number of times to execute the free game is determined, the CPU 40 operates the stop position lottery section of second rotary disk 84, where the stop position for the second rotary disk 37 is determined by lottery. Then, the CPU 40 drives the motor for second rotary disk 69 through the driver 68 to rotate the second rotary disk 37. After a predetermined time since the second rotary disk 37 has started rotating, the second display 37 is stopped at the position determined by the stop position lottery section of second rotary disk 84. The number indicated by the indicator 38 when the second rotary disk 37 stops rotating represents the odds of the dividend coins to be provided in the free game.

Figure 16:
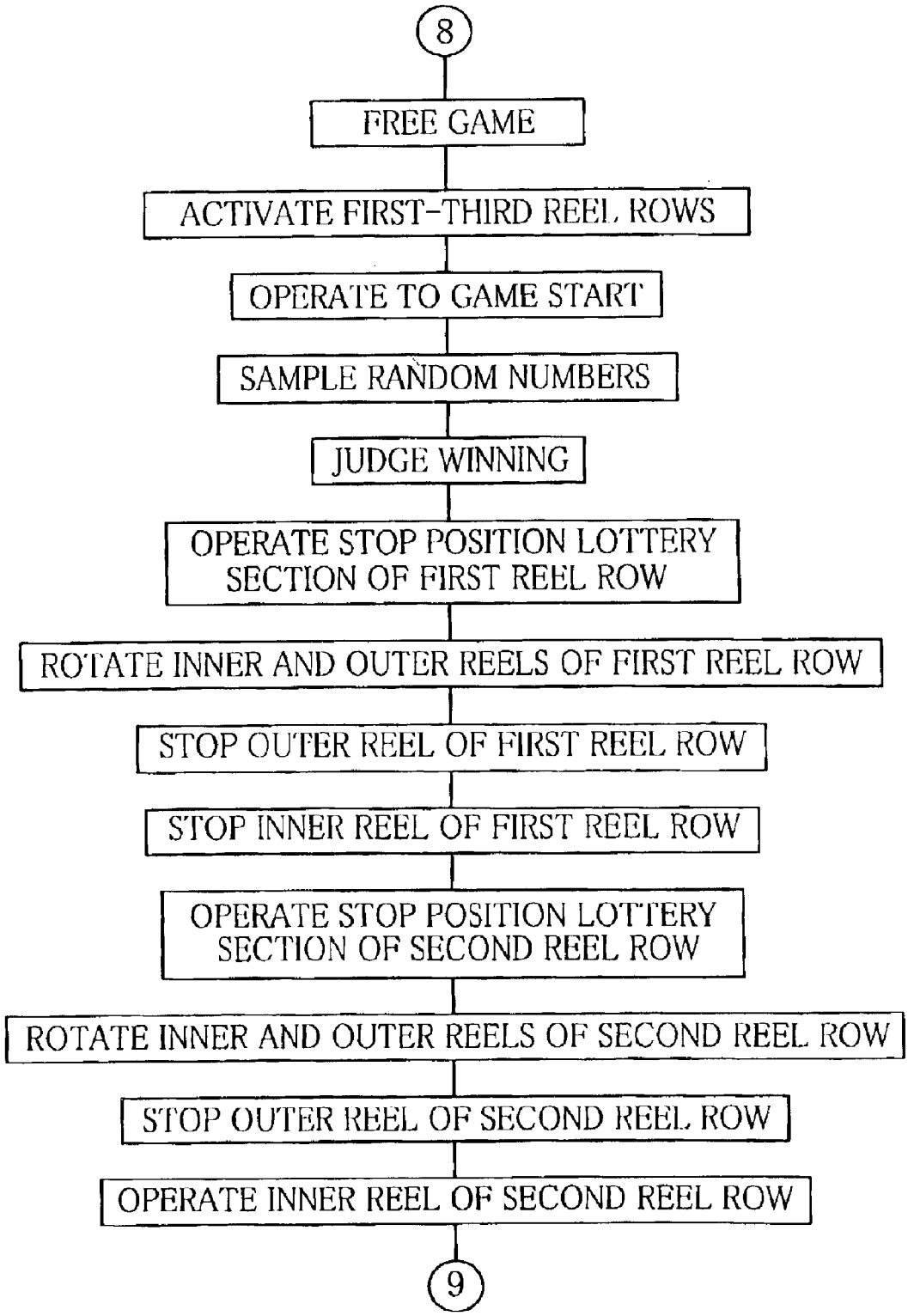
FIG. 16 is a flow chart of first half of free game.
Figure 17:
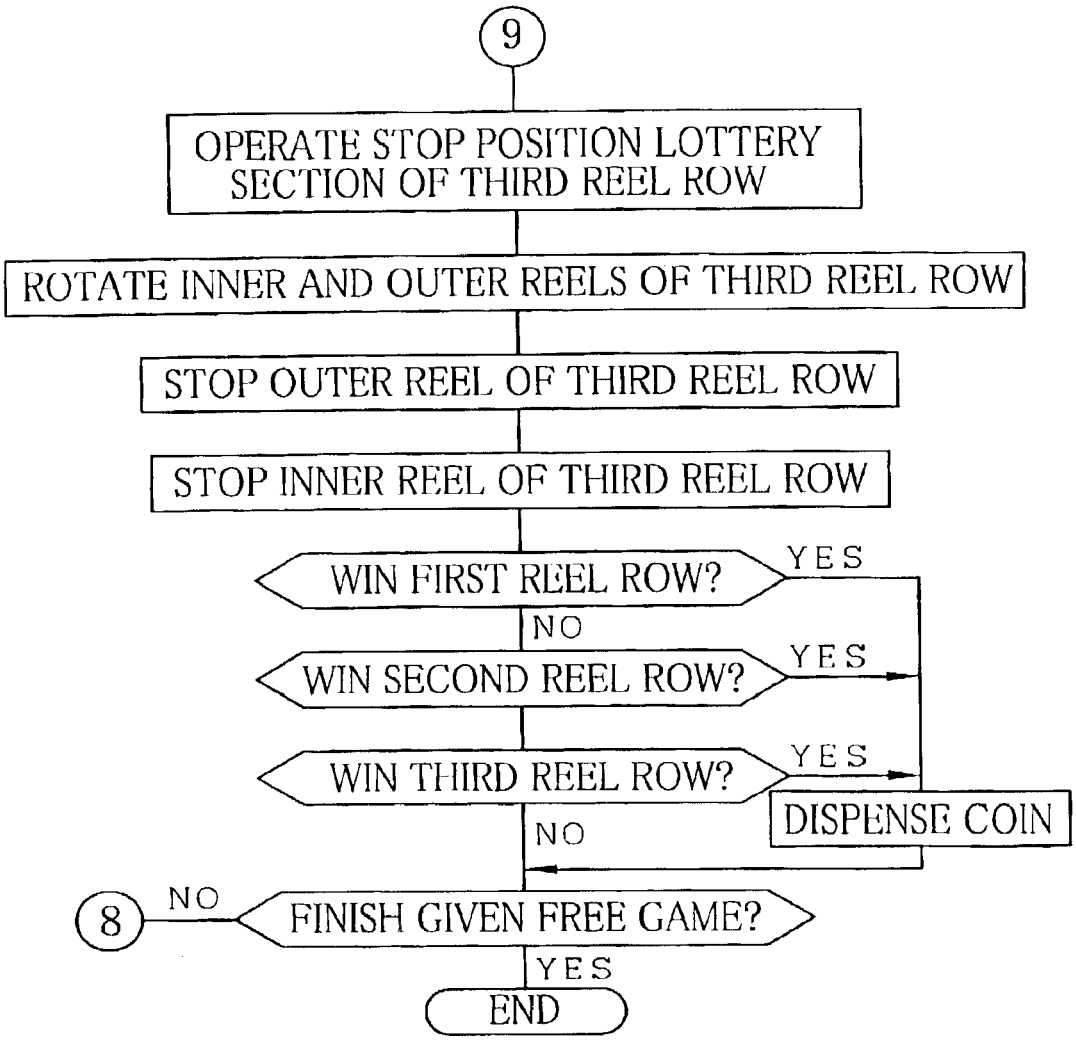
FIG. 17 is a flow chart of second half of free game.

As shown in FIGS. 16 and 17, the free game is started when the determining game of condition of free game is over. In the free game, the first, second and third reel rows 11–13 are actuated without inserting a coin, and the game is executed in the same way as three coins are betted. The winning is generated in the free game, the amount of the coins to be provided to the player is dividend coins gained by winning in a regular slot game multiplied by the odds determined by the second rotary disk 37 in the determining game of condition of free game.

The CPU 40 counts the number of times of the executed free game, which ends after being executed as many times as the number determined by the first rotary disk 36. After the free game, the regular slot game is executed as the player inserts coins. Accordingly, the CPU 40 has a function to provide the free game for the player as well.

In the above embodiment, plural slot games are executed simultaneously in the first, second and third reel rows 11–13 as the first game display devices. If the trigger symbol appears in any of the first, second and third reel rows 11–13, the player wins a free game. The first rotary disk 36 and the second rotary disk 37 are provided as the second game display devices, which determine the condition of the free game if the winning of the free game is completed in the first game display devices. As for the first and the second game display devices, their shapes and other elements may be changed in various ways.

Figure 18:
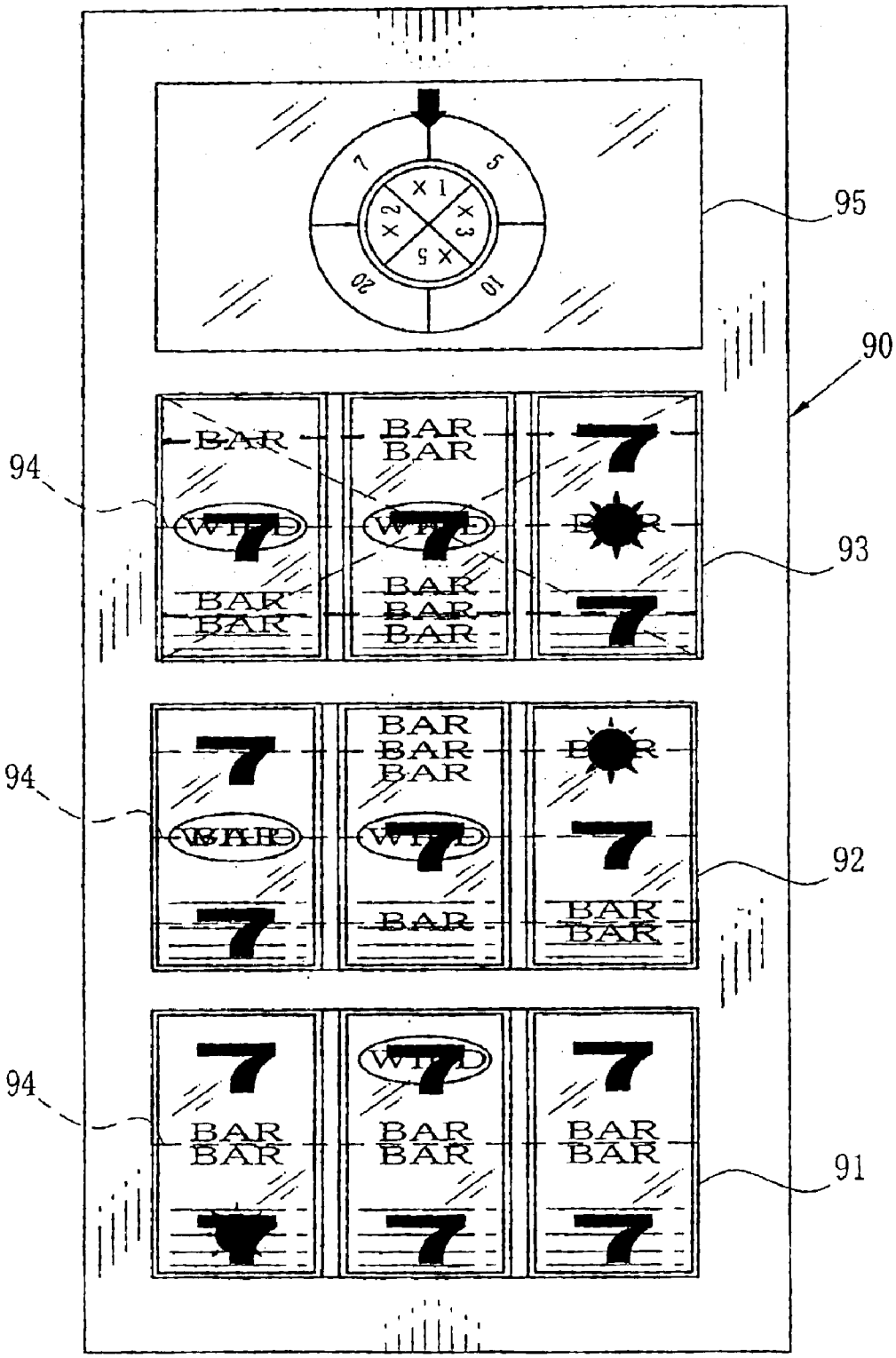
FIG. 18 is a front view of other embodiment of the game machine.

As shown in FIG. 18, a game machine 90 is provided with first, second and third reel rows 91–93. A horizontal winning line 94 is provided on the first reel row 91, and three horizontal winning lines 94 are provided on the second reel row 92. On the third reel row 93, three horizontal winning lines 94 and two oblique winning lines are provided. A liquid crystal display panel 95 is provided as well, on which the determining game of condition of the free game is displayed. As the player starts the game, the game is executed in the same game flow as the above-described slot machine 10 shown in FIG. 1. In this case, the first, second and third reel rows 91–93 have different numbers of the winning lines 94, and since the number of the winning lines 94 is increased in proportion to the number of bet, that raise the player's expectation to win the game. Additionally, various types of games may be executed by using the liquid crystal display panel 95 to execute the determining game of condition of the free game. Note that the liquid crystal display panel 95 may display a method of playing the game or animations while not executing the determining game of condition of the free game.

Figure 19:
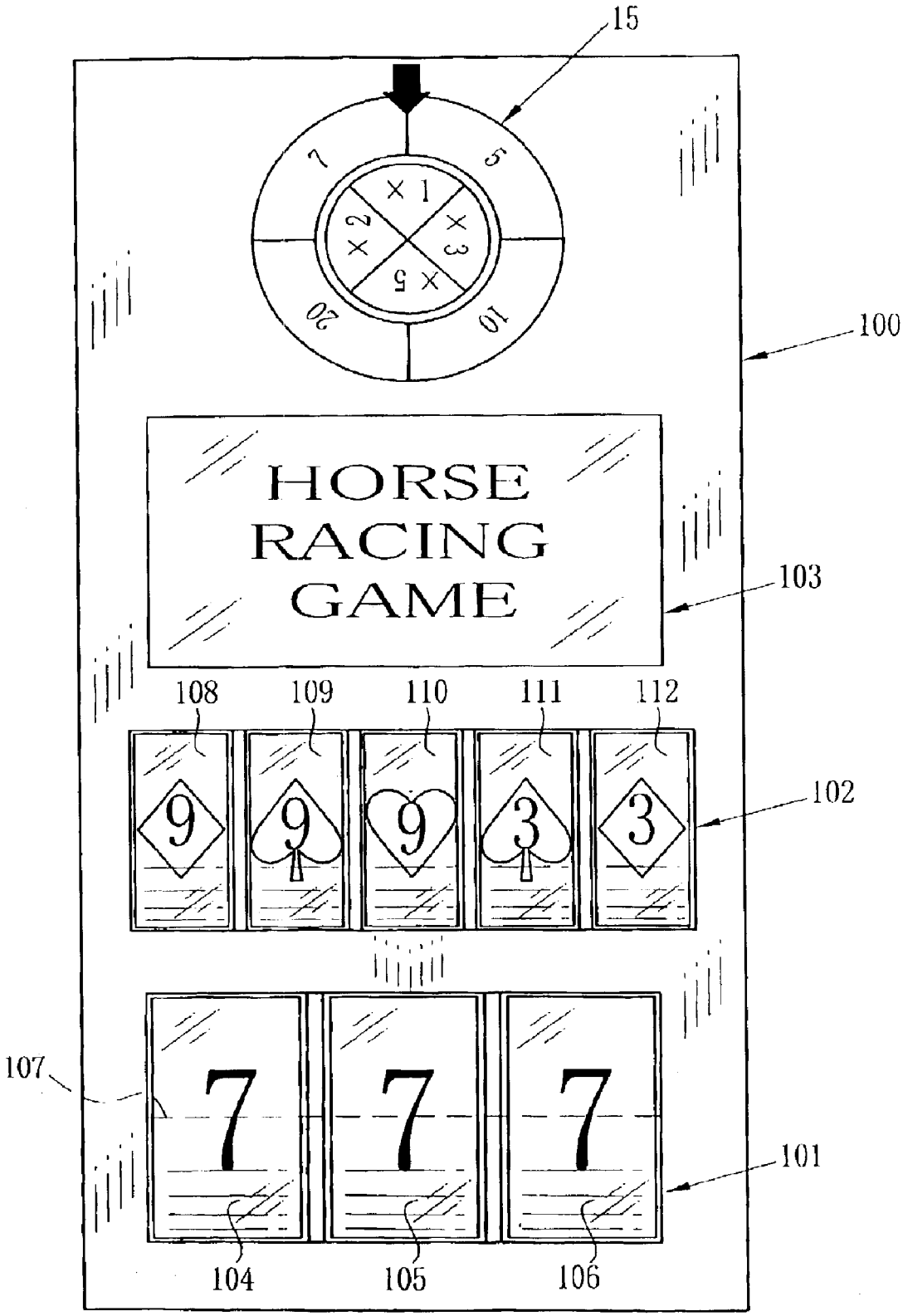
FIG. 19 is a front view of yet another embodiment of the game machine.

Also, plural game display devices, such as a slot game reel group 101, a card game reel group 102, and a liquid crystal display panel 103, are provided in a game machine 100 shown in FIG. 19.

Slot game is executed by the slot game reel group 101 wherein first, second and third reel units 104–106 and a horizontal winning line 107 are provided. A symbol is displayed on each of the first, second and third reel units 104–106, and the win or the loss is displayed in accordance with whether a predetermined combination of the symbols is stopped on the winning line 107. Note that FIG. 19 shows a condition of that the winning is generated by a combination of three "7"s.

Card game is executed by the card game reel group 102, wherein first, second, third, fourth and fifth reel units 108–112, respectively composed of an inner reel and an outer reel, are provided. The inner reels carry numbers of card game (A, 1, 2, . . . J, Q, and K), while the outer reels carry marks such as diamonds, spades, hearts and clovers. The win or the loss is determined in accordance with the combination of the symbols combined when both of the reels stop rotating. Note that FIG. 19 shows a situation of that the poker game is executed and full house is generated with three "9"s and two "3"s.

The liquid crystal display panel 103 executes horse racing game, and displays simulated scenes in which plural horses are racing. The player anticipates a particular horse to win before the horse racing game starts and inputs the anticipated result by operating the operation panel provided separately from the other operation panel. The win or the loss is determined depending on whether the player's anticipated result hits the right horse. Note that the composition of the operation panel and the method to input the anticipated result may be determined appropriately.

If the winning is generated in each of the slot game reel group 101, the card game reel group 102 and the liquid crystal display panel 103, the determining device of condition of the free game 15 is operated to start the determining game of condition of the free game in the same way as the embodiment described above. In this case, a variety of game contents may be provided, since different games are executed in one game machine. Note that the game contents of each game display device may be determined appropriately.

Other than three symbols of three reel units, the number of the symbols for composing symbol combinations may be four symbols of four reel units.

Though there are three symbols displayed in each display window and one winning line for each reel row or each reel group in the above embodiment, any number of the symbols to be displayed or the winning lines may be provided. Also, the number of coins the player is able to bet, types of the winning and the amount of dividend coins may be determined appropriately. The player's interest in the game may be stimulated by providing sound or lightning installation, for example, when the winning is generated or in a situation that the winning will be generated if the last reel stops with the display of particular symbols.

Though each reel unit has double reels in the above embodiment, it is possible to provide only one reel unit having double reels among the three reel units. In addition, methods and orders to stop the reels may be determined appropriately: for example, providing stop buttons for stopping each of the reels individually. Furthermore, the way of starting rotation of the reels may also be determined appropriately in such way as that, for example, the reels start rotating automatically when the 1–4 bet buttons 14*a*–14*d* are operated and coins are betted. Note that if the rotation of the inner reel first is stopped, it is preferable to provide continuous transparent part on the outer reels as many as the three symbols and to set the continuous transparent part in the display windows, so that the symbols on the inner reels may be observed clearly through the continuous transparent parts while rotating.

In the above embodiment, the winning of getting a free game is generated if at least one trigger symbol is displayed in one of the reel rows when the game ends in the first, second and third reel rows 11–13. Though the determining game of condition of the free game is executed in that case, the determining game of condition of the free game may also be determined to execute, for example, if the winning a free game is generated in two reel rows among three reel rows, if the total of the dividend coins the player gained reaches a predetermined amount, or if the total points of the winnings the player gained reaches a predetermined point.

Furthermore, it is also possible to determine as that the winning of getting a free game is generated only if the trigger symbol appears in all of the three reel rows.

In addition, privileges gained by using the plural game display devices are not only the determining game of condition of the free game. That is, for example, dividend coins may be dispensed as the winning if the same characters are indicated by the indicator when rotations of the first rotary disk and the second rotary disk are stopped, by providing plural kinds of characters on the first rotary disk and the second rotary disk in advance. Another example is to provide the player with appropriate privileges of arbitrary games such as bingo game, card game, and horse racing game played on the liquid crystal display panel provided instead of the determining device of condition of the free game 15.

Though two displays are provided in the determining device of number of free game 15 in the above embodiment, the number of the displays may be determined appropriately.

In the above embodiment, as a game display device, appropriate devices other than the reels may be used such as the liquid crystal panel, a dot-matrix display device composed of light emitting element such as LED, a display device of 7 segments method, and a device using CRT or organic EL.

Various changes and modifications are possible in the present invention and may be understood to be within the present invention.

What is claimed is:

1. A game machine comprising:

a predetermined number of plural game display devices for executing games independent from each other;

a first privilege providing means for judging whether a first winning is generated in said each game display device and for providing a first privilege for a player if said first winning is generated; and a second privilege providing means for judging whether a second winning is generated in said whole game display device and for providing a second privilege for the player if said second winning is generated, said second privilege being different from said first privilege, wherein said each game display device is actuatable by betting coins, wherein the number of said game display devices to be actuatable increases in proportion to the number of bet coins up to said predetermined number, and wherein said second privilege providing means comprises means for operating said second privilege when the number of said bet coins is one more than the number of said game display devices.

2. A game machine described in claim 1, wherein said first privilege is a predetermined amount of coins and said second privilege is a special game.

3. A game machine described in claim 2, wherein said special game is a free game to play without betting coins, and said game is executed by at least one of said game display devices.

4. A game machine described in claim 3, further comprising a determining device of condition of the free game, said determining device being operated to determine conditions of said free game when said second winning is generated.

5. A game machine described in claim 4, wherein conditions of said free game includes:

the number of times of said free game; and odds of dividend coins to provide as the first winning when said first winning is generated in said free game.

6. A game machine described in claim 5, wherein said determining device of condition of free game comprises:

a first rotary disk on which plural numbers are printed, one of said numbers in a particular position being selected as the number of times to execute free game when said first rotary disk stops rotating; and a second rotary disk on which plural odds are printed, one of said odds in a particular position being selected when said second rotary disk stops rotating.

7. A game machine described in claim 6, further comprising a pointer for indicating said particular position.

8. A game machine described in claim 5, wherein said each plural game display device comprises:

a reel row having plural reel units disposed in a line;

plural symbols for slot game carried on each of said reel units; and at least one winning line given across said reel row, said first winning or said second winning being determined depending on symbols appeared on said winning line.

9. A game machine described in claim 8, wherein one of said plural symbols is a particular symbol, and said second winning is generated if said special symbol stops on said winning line.

10. A game machine described in claim 5, wherein said plural game display devices execute different games.

11. A game machine described in claim 10, wherein said plural game display devices include at least plural reel groups for executing slot game and other plural reel groups for executing card game.

12. A game machine comprising:

a plurality of first game display devices for executing games independent from each other;

a second game display device different from said plural first game display devices;

at least one first indicator for each first game display device denoting a first winning in respective ones of said first game display devices and providing a payout for a player if said first winning is generated; and at least one second indicator different from said first indicator and displayed on at least one of said plural first game display devices denoting a bonus play for the player, said bonus play being executed on said plural first game display devices.

13. The game machine as claimed in claim 12, wherein said second game display device denotes a number of times said bonus play is executed.

14. The game machine as claimed in claim 12, wherein said bonus play is executed only when all of said plural first game display devices display said second indicator.

15. A game machine comprising:

a predetermined number of plural game display devices for executing games independent from each other, each of said plural game display devices having at least one winning line;

a first privilege providing means for judging whether a first winning is generated in each of said game display devices and for providing a first privilege for a player if said first winning is generated; and a second privilege providing means for judging whether a second winning is generated in said whole game display device and for providing a second privilege for the player if said second winning is generated, said second privilege being different from said first privilege, wherein said each game display device is actuatable by betting coins, wherein the number of said game display devices to be actuatable increases in proportion to the number of bet coins up to said predetermined number, and wherein a number of winning lines increases in proportion to the number of said bet coins.

* * * * *